United States Patent [19]

Teng

[11] Patent Number: 4,901,875

[45] Date of Patent: Feb. 20, 1990

[54] BOTTLE SEALER SERVING AS A TEMPERATURE BUFFER

[76] Inventor: Hsieh-Yih Teng, P.O. Box 10160, Taipei, Taiwan

[21] Appl. No.: 269,876

[22] Filed: Nov. 9, 1988

[51] Int. Cl.[4] ..... B65D 51/00

[52] U.S. Cl. ..... 215/271

[58] Field of Search ..... 215/271; 362/101

[56] References Cited

U.S. PATENT DOCUMENTS

| | | | |
|---|---|---|---|
| 2,034,739 | 3/1936 | Bodor | 215/271 X |
| 2,709,217 | 5/1955 | McCluskey | 362/101 |
| 2,986,297 | 5/1961 | Pollick | 215/271 |
| 3,374,344 | 3/1968 | Rudolph et al. | 362/101 |

FOREIGN PATENT DOCUMENTS

| | | | |
|---|---|---|---|
| 1138982 | 2/1957 | France | 215/271 |

*Primary Examiner*—Donald F. Norton

[57] ABSTRACT

A bottle sealer includes a telescopic expansible hollow extension formed on an annular portion of the sealer sealed in a bottleneck, and fluidically communicated with a liquid filled in a bottle so that when the bottle filled with a liquid or water is subjected to a freezing temperature to become ice, the telescopic hollow extension may serve as a buffer for absorbing the volume expansion due to a conversion of water into ice.

1 Claim, 1 Drawing Sheet

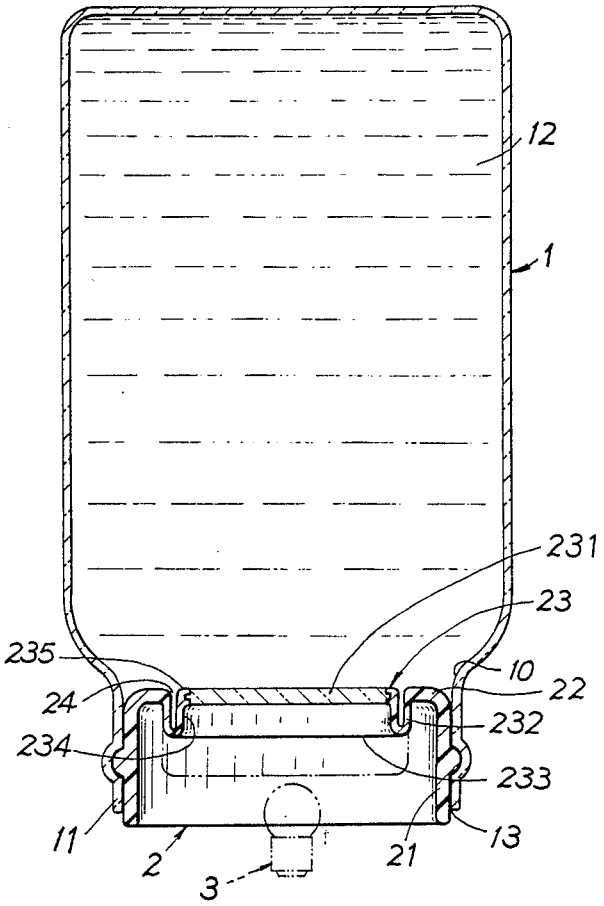
12
1
231
23
235
10
22
24
232
234
233
11
13
2
21
3

BOTTLE SEALER SERVING AS A TEMPERATURE BUFFER

BACKGROUND OF THE INVENTION:

U. S. Pat. No. 4,771,902 issued to the same applicant of this application discloses a container having a bottleneck inversely mounted on a base packed by a bell-shape sealer made of elastomer materials, of which the sealer includes plural annular extension rings concentrically circumferentially formed on an inside wall of the sealer, adapted to be turned up along the bottleneck to pack the bottle-neck tightly in a base when inversely mounting the container on the supporting base.

However, such a container, when filled with water and subjected to a temperature below zero degree centigrade, may be broken since the inside water is frozen to expand its volume to cause breakage of a glass container, especially when transported in a very cold weather.

The present inventor has found the defects of the original invention and invented the present sealer having a buffer effect especially for a cold temperature.

SUMMARY OF THE INVENTION

The object of the present invention is to provide a bottle sealer having a telescopic expansible hollow extension fluidically communicated with the bottle so that when the bottle filled with water is subjected to an environment temperature below zero degree centigrade to freeze the inside water to become ice, the volume expansion due to the conversion of water to ice may expand the telescopic extension without expansibly breaking a glass bottle.

BRIEF DESCRIPTION OF THE DRAWING

The single drawing is a sectional elevation of the present invention.

DETAILED DESCRIPTION

As shown in the figure, the present invention comprises: a sealer 2 sealing in a bottleneck 11 of a bottle 1 which may be a container for filling liquid 12 therein or may be a transparent crystal ball for decorative purpose. The sealer 2 may be made of elastomer materials such as rubber or silicon rubber. For decorative purpose, a decorative article such as a doll, a figure, or an animal may be mounted on the sealer 2 inside the bottle 1.

The sealer 2 includes: a cylindrical skirt portion 21 protruding outwardly from an inner annular portion 22 for sealing an outer edge 13 of the bottleneck 11, the inner annular portion 22 sealably inserted in a taper portion 10 of the bottle 1 within the bottleneck 11, and a telescopic expansible hollow extension 23 which is formed as a flip-flop extension as shown in the figure, concave outwardly from the inner annular portion 22 to form an outer cylinder portion 232 having an outer edge 233 and then convex inwardly to form an inner cylinder portion 234 having a base portion 235 coplanar to a surface of the inner annular portion 22. There is an aperture 24 between the inner cylinder portion 234 and the outer cylinder portion 232 of the flip-flop extension 23. The extension 23 has its one end portion closed to act like a bag for absorbing the expansion volume of bottle liquid 12.

For illuminating decorative purpose, a transparent bottom plate 231 is embedded in the base plate 235 so that a light source 3 may be installed under the sealer 2 for lighting the inside content 12 in the bottle 1.

When handling the water-filled glass bottle 1 of this invention in a freezing weather such as below zero degree centigrade, the water 12 may be frozen to become ice to expand its volume inside the bottle, causing an expansion of the telescopic extension 23, without breaking the bottle 1.

Since the sealer 2 is made of elastomers such as rubber which is a thermal insulator, the sealer 2 which subjected to a freezing weather may delay the freezing rate of its nearby water than the remaining water inside the glass bottle 1 so as to prevent an earlier ice formation and clogging in the aperture 24 of the extension 23.

When a conventional crystal ball filled with decorative article and water in the ball is sealed with the present sealer 2, it will not be broken even handled in a freezing weather since the volume expansion due to the conversion of water into ice may be absorbed in the telescopic hollow extension 23 as aforementioned.

For display purpose, a base or holder (not shown) may be further provided for inserting the bottleneck into a socket of the base or holder for a stable arrangement.

I claim:

1. A bottle sealer made of elastomer materials sealably inserted in a bottleneck of a bottle comprising:

an inner annular portion sealably inserted in a bottleneck;

a cylindrical skirt portion protruding outwardly from said inner annular portion to seal an outer edge of the bottleneck; and a telescopic expansible hollow extension joined to said inner annular portion having one end portion of said extension closed and having means for contacting a liquid filled inside the bottle and operatively expansible within the bottleneck when subjected to a cold environment temperature below zero degree centigrade for absorbing a volume expansion of the liquid inside the bottle, without breaking the bottle made of glass or the like;

said telescopic expansible hollow extension including a flip-flop extension concave outwardly from the inner annular portion to form an outer cylinder portion defining an outer edge of the outer cylinder portion which is then convex inwardly opposite to an outer edge of the bottleneck to form an inner cylinder portion having a base portion generally coplanar to a surface of the inner annular portion, a cylindrical aperture being defined between the inner cylinder portion and the outer cylinder portion of said hollow extension, said base portion of said inner cylinder portion being embedded with a transparent bottom plate therein.

* * * * *